US011067934B2

(12) United States Patent
Kato et al.

(10) Patent No.: US 11,067,934 B2
(45) Date of Patent: Jul. 20, 2021

(54) IMAGE FORMING APPARATUS USABLE FOR WASTE TONER COLLECTION UP TO MAXIMUM CAPACITY OF TONER CONTAINER

(71) Applicant: KYOCERA Document Solutions Inc., Osaka (JP)

(72) Inventors: Yui Kato, Osaka (JP); Koji Minamino, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/922,985

(22) Filed: Jul. 7, 2020

(65) Prior Publication Data

US 2021/0011414 A1 Jan. 14, 2021

(30) Foreign Application Priority Data

Jul. 10, 2019 (JP) ..... JP2019-128385

(51) Int. Cl.
*G03G 21/10* (2006.01)
*G03G 15/00* (2006.01)
*G03G 21/12* (2006.01)

(52) U.S. Cl.
CPC ..... *G03G 15/556* (2013.01); *G03G 21/10* (2013.01); *G03G 21/12* (2013.01); *G03G 2221/1624* (2013.01)

(58) Field of Classification Search
CPC ..... G03G 15/556; G03G 21/10; G03G 21/12; G03G 2215/066; G03G 2215/0685; G03G 2221/1624; G03G 15/0868
See application file for complete search history.

(56) References Cited

U.S. PATENT DOCUMENTS

2011/0129240 A1* 6/2011 Uno ..... G03G 15/0806 399/30
2013/0343770 A1* 12/2013 Hewitt ..... G03G 15/5016 399/12
2019/0361378 A1* 11/2019 Hoshino ..... G03G 15/5054

FOREIGN PATENT DOCUMENTS

JP 2018-054896 A 4/2018

* cited by examiner

*Primary Examiner* — Walter L Lindsay, Jr.
*Assistant Examiner* — Laura Roth
(74) *Attorney, Agent, or Firm* — Studebaker & Brackett PC

(57) ABSTRACT

A toner container including non-volatile memory is mounted to a first mounting section, and a toner container already used is mounted as a waste toner bottle to a second mounting section. Every time a supplied amount of toner is calculated, a writing section writes an integrated value of the supplied amount as a current value and a maximum value in the non-volatile memory. Every time the generated amount of waste toner is calculated, an updating section updates the current value stored in the non-volatile memory by subtracting the generated amount from the current value. A detecting section detects fullness of the waste toner bottle when the current value stored in the non-volatile memory of the toner container mounted as the waste toner bottle to the second mounting section becomes no greater than a value obtained by subtracting an initial remaining space of the toner container from 0.

5 Claims, 7 Drawing Sheets

IMAGE FORMING APPARATUS USABLE FOR WASTE TONER COLLECTION UP TO MAXIMUM CAPACITY OF TONER CONTAINER

INCORPORATION BY REFERENCE

The present application claims priority under 35 U.S.C. § 119 to Japanese Patent Application No. 2019-128385 filed on Jul. 10, 2019. The contents of this application are incorporated herein by reference in their entirety.

BACKGROUND

The present disclosure relates to an image forming apparatus.

In a known image forming apparatus, a used container for supplying toner (toner container) can be used as a container for collecting waste toner (waste toner bottle).

In an image forming apparatus, fullness of a waste toner bottle is detected when a same amount of waste toner as a supplied amount of toner from a toner container has been collected.

SUMMARY

An image forming apparatus according to an aspect of the present disclosure is an image forming apparatus that supplies toner contained in a toner container at a time of executing image formation and collects toner remaining after the image formation as waste toner into a waste toner bottle. The image forming apparatus includes a first mounting section, a first calculating section, a writing section, a second mounting section, a second calculating section, an updating section, and a detecting section, and the toner container includes non-volatile memory. To the first mounting section, the toner container is mounted. The first calculating section calculates a supplied amount of the toner based on image data. Every time the supplied amount is calculated, the writing section writes an integrated value of the supplied amount of toner as a current value and a maximum value in the non-volatile memory of the toner container mounted to the first mounting section. To the second mounting section, the toner container already used is mounted as the waste toner bottle. The second calculating section calculates a generated amount of the waste toner based on the image data. Every time the generated amount is calculated, the updating section updates the current value by subtracting the generated amount from the current value stored in the non-volatile memory of the toner container mounted as the waste toner bottle to the second mounting section. The detecting section detects fullness of the waste toner bottle when the current value stored in the non-volatile memory of the toner container mounted as the waste toner bottle to the second mounting section becomes no greater than a value obtained by subtracting a maximum capacity of the toner container from an initial amount of the toner in the toner container.

DETAILED DESCRIPTION

Figure 1:
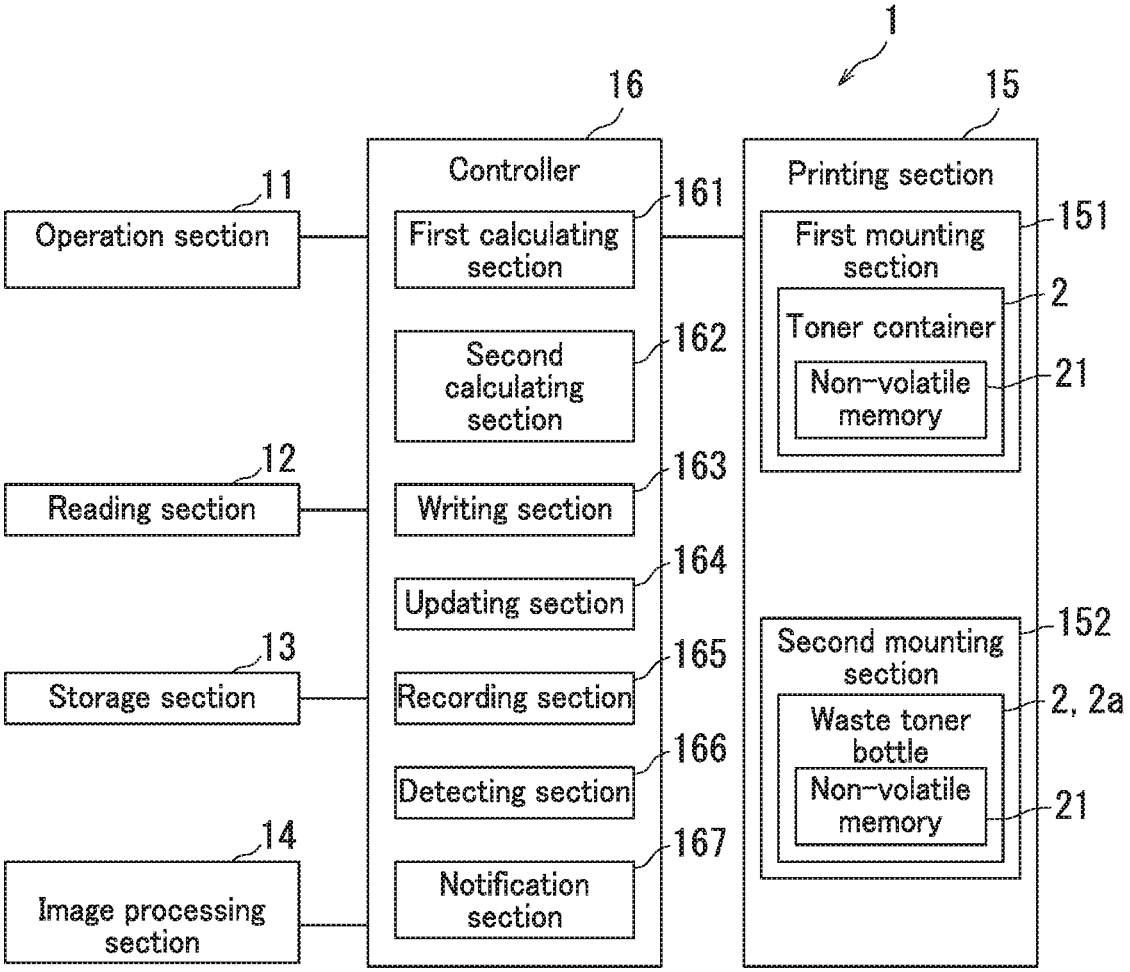
FIG. 1 is a block diagram illustrating an example of an image forming apparatus according to an embodiment.

The following describes embodiments of the present disclosure with reference to FIGS. 1 to 7. In the drawings, the same or corresponding elements are assigned the same reference signs, and descriptions thereof are omitted.

First, with reference to FIG. 1, an image forming apparatus 1 according to an embodiment will be described. FIG. 1 is a block diagram illustrating an example of the image forming apparatus 1.

As illustrated in FIG. 1, the image forming apparatus 1 includes an operation section 11, a reading section 12, a storage section 13, an image processing section 14, a printing section 15, and a controller 16.

The operation section 11 includes a touch panel, displays a message to a user, and receives an operation by the user.

The reading section 12, which is a so-called scanner, reads a document to acquire image data.

The storage section 13 includes a storage device such as semiconductor memory to store data and a computer program. For example, the storage section 13 stores image data acquired by the reading section 12.

The image processing section 14 performs specified image processing on the image data. For example, the image processing section 14 executes an image improvement process such as a gradation adjustment process.

The printing section 15 prints an image on a recording sheet based on the image data read from the storage section 13. The printing section 15 includes a first mounting section 151 and a second mounting section 152. To the first mounting section 151, a toner container 2 is mounted. The toner container 2 includes non-volatile memory 21. To the second mounting section 152, a toner container 2 already used is mounted as a waste toner bottle 2*a*.

The printing section 15 forms a latent image on a surface of a photosensitive drum based on the image data read out from the storage section 13. Subsequently, the printing section 15 supplies toner contained in the toner container 2 to a developing section to perform image formation that converts the latent image into a toner image. Further, the printing section 15 transfers the toner image from the photosensitive drum to a recording sheet, fixes the transferred toner image on the recording paper, and ejects the sheet. Finally, the printing section 15 removes the toner remaining on the photosensitive drum and collects the removed toner as waste toner into the waste toner bottle 2*a*.

Figure 2:
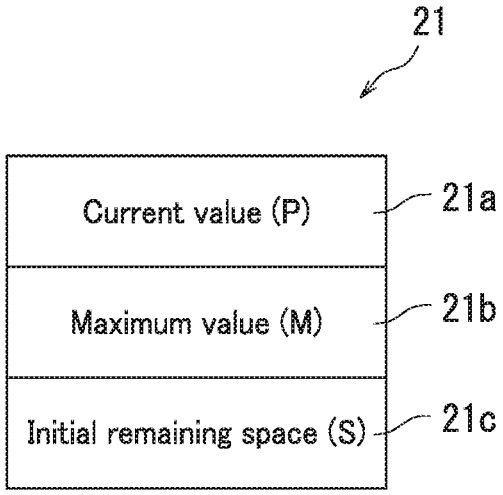
FIG. 2 is a diagram illustrating an example of stored contents of non-volatile memory.

Next, stored contents of the non-volatile memory 21 will be described with reference to FIGS. 1 and 2. FIG. 2 is a diagram illustrating an example of stored contents of the non-volatile memory 21.

As illustrated in FIG. 2, the non-volatile memory 21 includes a first region 21*a* for storing a current value P, a second region 21*b* for storing a maximum value M, and a third region 21*c* for storing an initial remaining space S. In the non-volatile memory 21 of an unused toner container 2, the current value P and the maximum value M are both initialized to 0.

While the toner container 2 is mounted to the first mounting section 151, the first region 21*a* stores an integrated value of the supplied amount of toner as the current value P calculated every time image formation is performed (current value P=current value P+supplied amount of toner). Meanwhile, the second region 21*b* stores a value equal to the current value P as the maximum value M. That is, while the toner container 2 is mounted to the first mounting section 151, the current value P and the maximum value M stored in the non-volatile memory 21 indicate an integrated supplied amount of toner from the toner container 2.

At the time when the used toner container 2 is mounted to the second mounting section 152 as a waste toner bottle 2*a*, the non-volatile memory 21 stores an integrated supplied amount of toner up to the time point as the current value P and the maximum value M. Once the toner container 2 starts to be used as a waste toner bottle 2*a*, the generated amount of waste toner calculated every time image formation is performed is subtracted from the current value P stored in the first region 21*a* (current value P=current value P−generated amount of waste toner). The maximum value M stored in the second region 21*b* is not updated.

The third region 21*c* stores the initial remaining space S. The initial remaining space S is a value obtained by subtracting an initial amount Y of the toner in the toner container 2 from a maximum capacity X of the toner container 2 (S=X−Y>0). The maximum capacity X is known when the toner container 2 is manufactured. The initial amount Y is known when the toner container 2 is charged with toner. Accordingly, the maximum capacity X, the initial amount Y, and the initial remaining space S are known when the toner container 2 charged with toner is shipped. The initial remaining space S is written in the third region 21*c* when the toner container 2 is shipped, for example. Similarly, when the toner container 2 is shipped, 0 is written in the first region 21*a* as the initial value of the current value P, and 0 is written in the second region 21*b* as the initial value of the maximum value M.

Returning to FIG. 1, the controller 16 is connected to each of the operation section 11, the reading section 12, the storage section 13, the image processing section 14, and the printing section 15. The controller 16 includes a processor. The processor is for example a central processing unit (CPU).

The controller 16 includes a first calculating section 161, a second calculating section 162, a writing section 163, an updating section 164, a recording section 165, a detecting section 166, and a notification section 167. The processor of the controller 16 executes the computer program stored in the storage device of the storage section 13, thereby functioning as the first calculating section 161, the second calculating section 162, the writing section 163, the updating section 164, the recording section 165, the detecting section 166, and the notification section 167.

The first calculating section 161 calculates a supplied amount of toner from the toner container 2 based on a coverage rate (dot count) of the image data when the printing section 15 performs image formation.

The second calculating section 162 calculates a generated amount of waste toner based on the coverage rate of the image data×(100−transfer efficiency) when the printing section 15 performs image formation.

Every time the supplied amount of toner is calculated by the first calculating section 161, the writing section 163 writes an integrated value of the supplied amount of toner as the current value P and the maximum value M in the non-volatile memory 21 of the toner container 2 mounted to the first mounting section 151. More specifically, the writing section 163 updates the current value P by adding the calculated supplied amount of toner to the current value P, and also updates the maximum value M so that the maximum value M will be the same value as the updated current value P. That is, the current value P and the maximum value M are updated so that the supplied amount of toner is integrated in the positive direction.

Every time the generated amount of waste toner is calculated by the second calculating section 162, the updating section 164 updates the current value P. Specifically, the updating section 164 subtracts the calculated generated amount of waste toner from the current value P stored in the non-volatile memory 21 of the toner container 2 mounted as the waste toner bottle 2*a* to the second mounting section 152. That is, the current value P is updated so that the generated amount of waste toner is integrated in the negative direction.

The recording section 165 records the mounting of the toner container 2 as the waste toner bottle 2*a* when it is determined that the toner container 2 mounted to the second mounting section 152 is used as the waste toner bottle 2*a*. Specifically, the recording section 165 updates the current value P by subtracting a specified value (for example, 1) from the current value P stored in the non-volatile memory 21 of the toner container 2. That is, the current value P and the maximum value M are the same value as long as the toner container 2 is mounted to the first mounting section 151 and used in the state. By contrast, the current value P is changed to a value smaller than the maximum value M in a case where it is determined that the toner container 2 mounted to the second mounting section 152 is used as the waste toner bottle 2*a*.

The detecting section 166 detects fullness of the waste toner bottle 2*a* under a specified condition and notifies the user of a message that the waste toner bottle 2*a* is full. The specified condition is that the current value P stored in the non-volatile memory 21 of the toner container 2 mounted as the waste toner bottle 2*a* to the second mounting section 152 has become no greater than "−S". "−S" is equal to a value obtained by subtracting the maximum capacity X of the toner container 2 from the initial amount Y of the toner in the toner container 2 (Y−X<0).

In a case where the current value P stored in the non-volatile memory 21 of the toner container 2 mounted as the waste toner bottle 2*a* to the second mounting section 152 is no greater than a threshold value T, the notification section 167 notifies a message that a toner container 2 capable of supplying toner is mounted. The reason is that usable toner remains in the toner container 2. Further, the notification section 167 compares the current value P stored in the non-volatile memory 21 of the toner container 2 mounted to the first mounting section 151 with the maximum value M, and if the current value P is smaller than the maximum value M, notifies the user of a message that the toner container 2 is incorrectly mounted. The reason is that the current value P smaller than the maximum value M indicates that the toner container 2 has already been reused as the waste toner bottle 2*a*.

Figure 3:
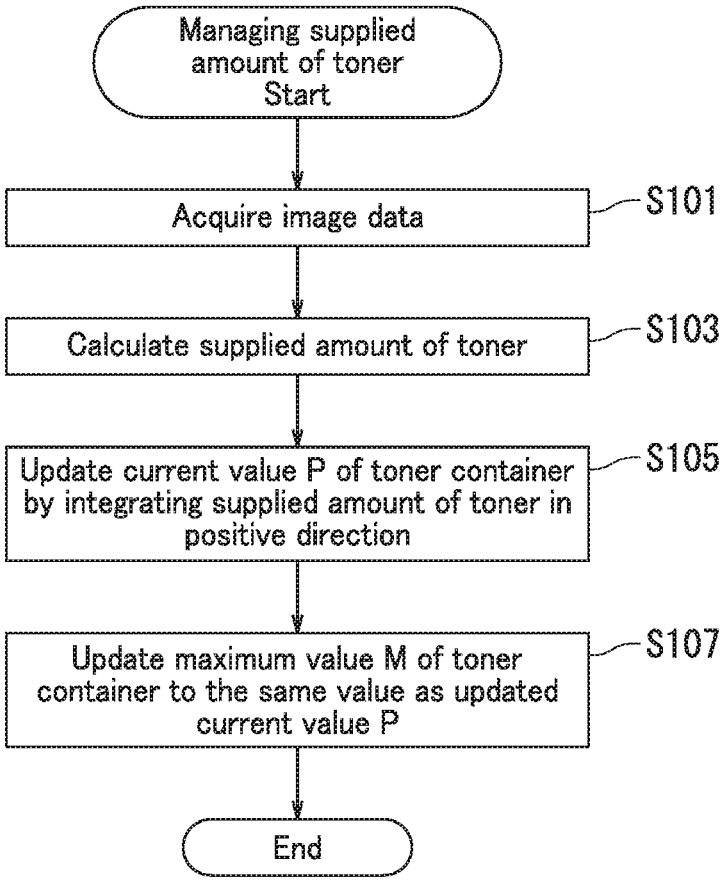
FIG. 3 is a flowchart illustrating an example of process of a controller.
Figure 4:
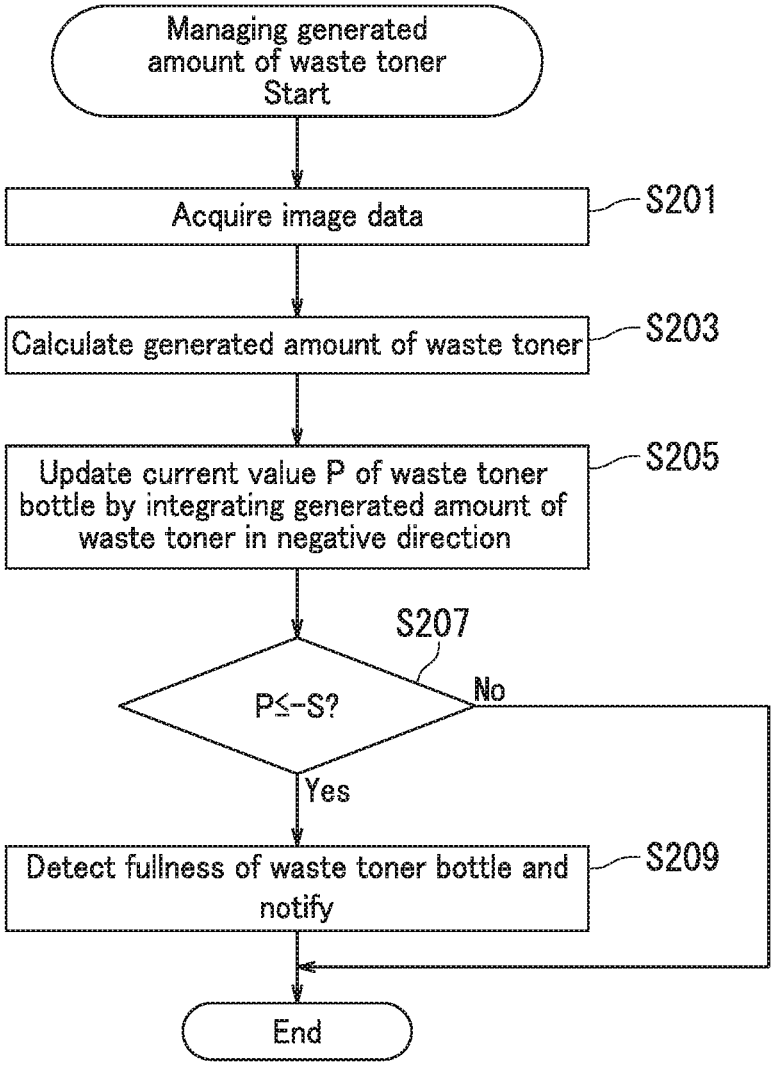
FIG. 4 is a flowchart illustrating an example of process of the controller.

Next, process of the controller 16 will be described with reference to FIGS. 1 to 4. FIGS. 3 and 4 are each a flowchart illustrating an example of process of the controller 16. FIG. 3 shows an example of managing supplied amount of toner, and FIG. 4 shows an example of managing generated amount of waste toner.

Step S101: As illustrated in FIG. 3, the first calculating section 161 acquires image data for an image to be printed.

Step S103: The first calculating section 161 calculates the supplied amount of toner based on the coverage rate of the image data.

Step S105: The writing section 163 updates the current value P stored in the non-volatile memory 21 of the toner container 2 so that the supplied amount of toner calculated by the first calculating section 161 is integrated in the positive direction.

Step S107: The writing section 163 updates the maximum value M stored in the non-volatile memory 21 of the toner container 2 so that the maximum value M becomes the same value as the updated current value P.

Step S201: As illustrated in FIG. 4, the second calculating section 162 acquires image data for the image to be printed.

Step S203: The second calculating section 162 calculates the generated amount of waste toner based on the coverage rate and the transfer efficiency of the image data.

Step S205: The updating section 164 updates the current value P stored in the non-volatile memory 21 of the toner container 2 mounted as the waste toner bottle 2*a* so that the generated amount of waste toner calculated by the second calculating section 162 is integrated in the negative direction.

Step S207: The detecting section 166 determines whether or not the current value P stored in the non-volatile memory 21 of the toner container 2 mounted as the waste toner bottle 2*a* is no greater than −S. If the detecting section 166 determines that the current value P is no greater than −S (Yes in Step S207), the process of the controller 16 proceeds to Step S209. If the detecting section 166 determines that the current value P is greater than −S (No in Step S207), the process of the controller 16 ends.

Step S209: The detecting section 166 detects the fullness of the waste toner bottle 2*a* and notifies the user of the fullness. After that, the process of the controller 16 ends.

Upon receiving the message that the waste toner bottle 2*a* is full, the user removes the toner container 2 mounted as the waste toner bottle 2*a* to the second mounting section 152. The removed waste toner bottle 2*a* is filled with waste toner up to the maximum capacity X regardless of the initial amount Y of the toner in the toner container 2.

Figure 5:
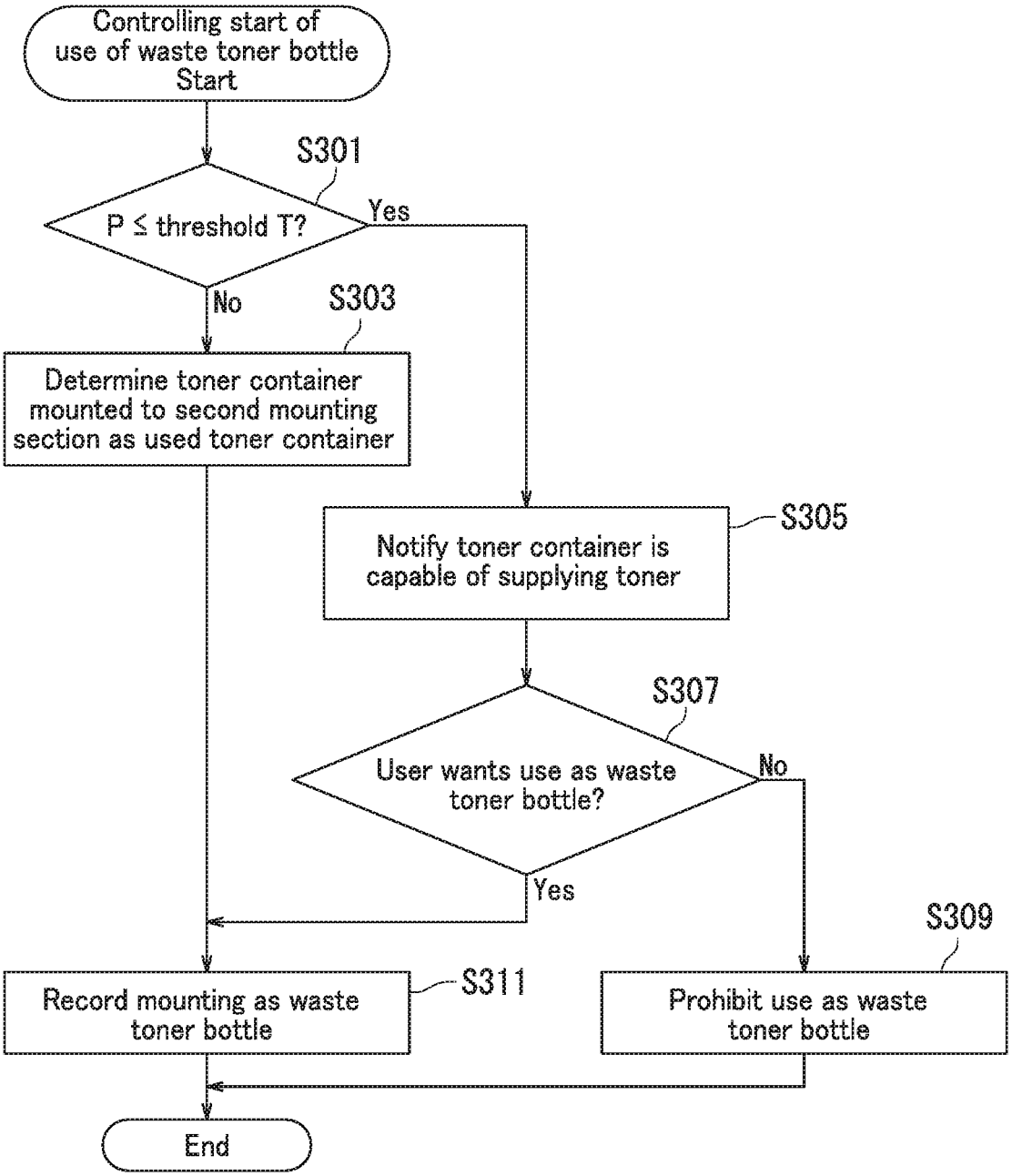
FIG. 5 is a flowchart illustrating an example of process of the controller.
Figure 6:
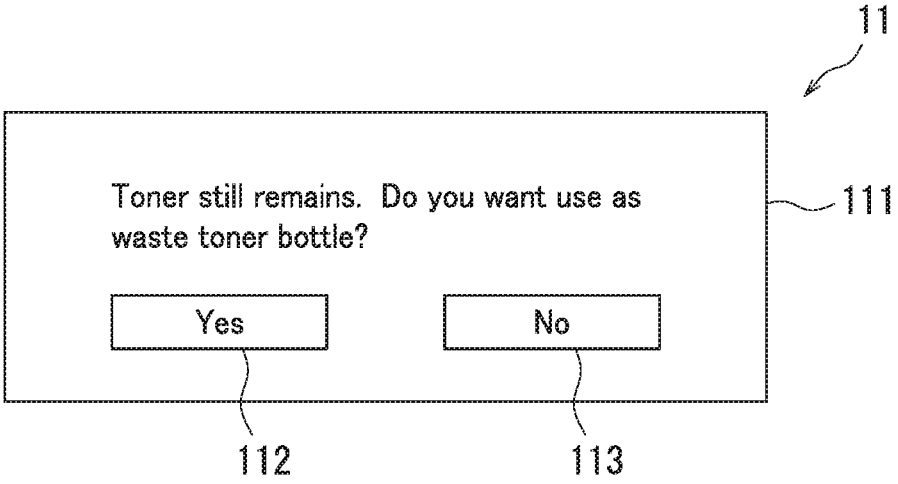
FIG. 6 is a diagram illustrating an example of a display on an operation section.

Next, process of the controller 16 will be further described with reference to FIGS. 1, 2, 5, and 6. FIG. 5 is a flowchart illustrating an example of process of the controller 16 at the time when the use of the waste toner bottle 2*a* is started. FIG. 6 is a diagram illustrating an example of a display on the operation section 11.

Step S301: As illustrated in FIG. 5, the recording section 165 determines whether or not the current value P stored in the non-volatile memory 21 of the toner container 2 mounted as the waste toner bottle 2*a* to the second mounting section 152 is no greater than the threshold value T. If the recording section 165 determines that the current value P is no greater than the threshold value T (Yes in Step S301), the process of the controller 16 proceeds to Step S305. If the recording section 165 determines that the current value P is greater than the threshold value T (No in Step S301), the process of the controller 16 proceeds to Step S303. The threshold value T is for example a value indicating 90% of the total amount of the toner that was contained in the toner container 2.

Step S303: The recording section 165 determines that the toner container 2 mounted to the second mounting section 152 is a used toner container 2. After that, the process of the controller 16 proceeds to Step S311.

Step S305: The notification section 167 notifies a message that the toner container 2 still capable of supplying toner is mounted to the second mounting section 152, for example, a message saying "Toner still remains. Do you want use as waste toner bottle?".

The operation section 11 displays a first input button 112 marked "Yes" and a second input button 113 marked "No" in addition to the message notified by the notification section 167 on the touch panel 111 as illustrated in FIG. 6. If the user wants to use the toner container 2 mounted to the second mounting section 152 as the waste toner bottle 2*a*, the user presses the first input button 112. If the user wants to remove the toner container 2 mounted to the second mounting section 152 and remount it to the first mounting section 151, the user presses the second input button 113.

Step S307: As illustrated in FIG. 5, the recording section 165 determines whether or not the user wants use as the waste toner bottle 2*a*. If the recording section 165 determines that the user wants use as the waste toner bottle 2*a* (Yes in Step S307), the process of the controller 16 proceeds to Step S311. If the recording section 165 determines that the user does not want use as the waste toner bottle 2*a* (No in Step S307), the process of the controller 16 proceeds to Step S309.

The process of the controller 16 proceeds from Step S307 to Step S311 in a case where an input indicating that the user wants use as the waste toner bottle 2*a* is obtained. This corresponds to a case where the first input button 112 is pressed in the example of FIG. 6. The process of the controller 16 proceeds from Step S307 to Step S309 in the case where an input indicating that the user does not want use as the waste toner bottle 2*a* is obtained. This corresponds to the case where the second input button 113 is pressed in the example of FIG. 6.

Step S309: The recording section 165 prohibits use as the waste toner bottle 2*a* so as to prevent the waste toner from being collected into the toner container 2 mounted to the second mounting section 152. After that, the process of the controller 16 ends.

Step S311: The recording section 165 records mounting as the waste toner bottle 2*a*. Specifically, the recording section 165 updates the current value P by subtracting a specified value (for example, 1) from the current value P stored in the non-volatile memory 21 of the toner container 2 mounted as the waste toner bottle 2*a* to the second mounting section 152. After that, the process of the controller 16 ends.

Figure 7:
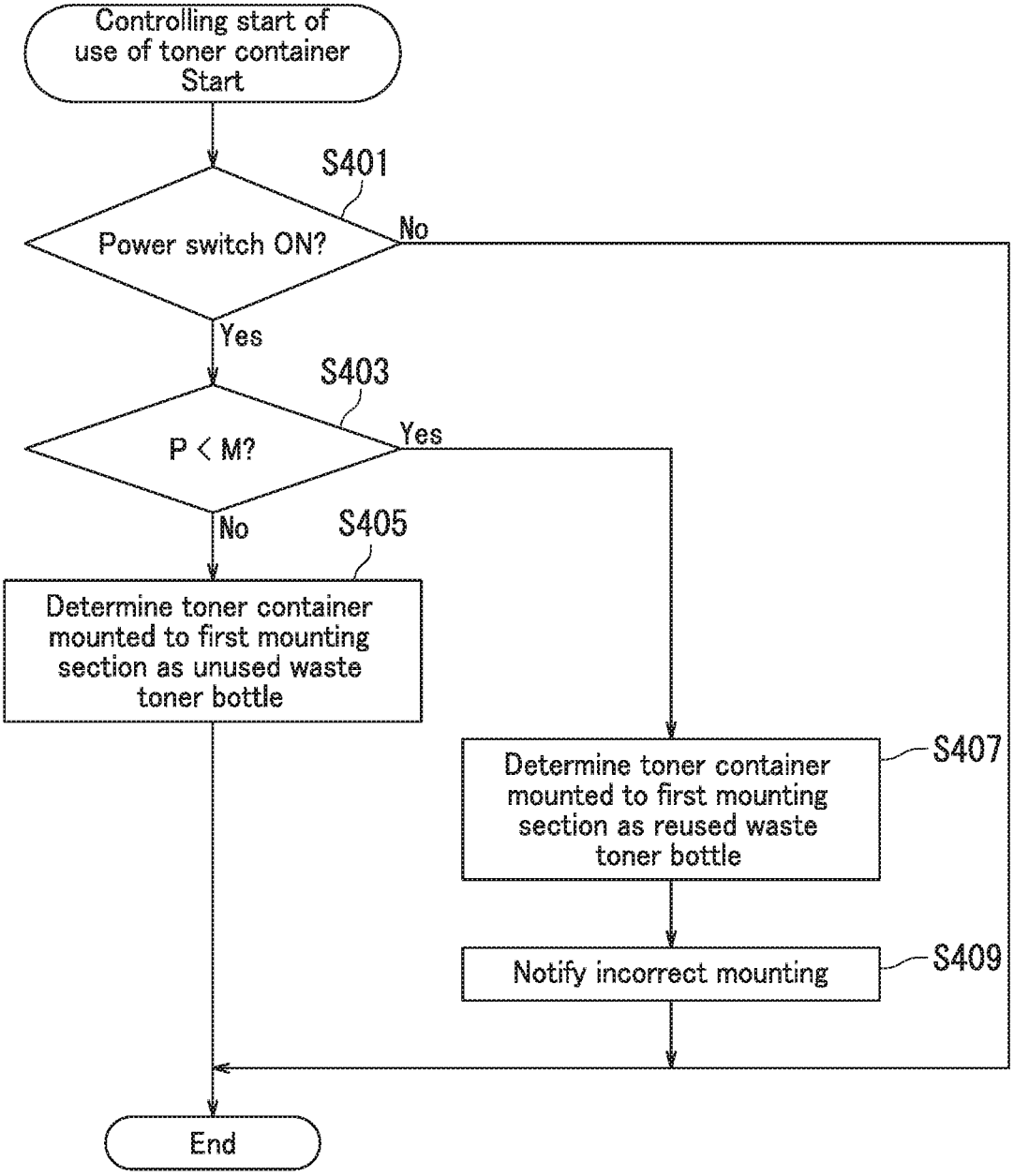
FIG. 7 is a flowchart illustrating an example of process of the controller.

Next, process of the controller 16 will be further described with reference to FIGS. 1, 2, and 7. FIG. 7 is a flowchart illustrating an example of process of the controller 16 at the time when the use of the toner container 2 is started.

Step S401: The controller 16 determines whether or not the power switch of the image forming apparatus 1 has been turned on. If the controller 16 determines that the power switch of the image forming apparatus 1 has been turned on (Yes in step S401), the process of the controller 16 proceeds to step S403. If the controller 16 determines that the power switch of the image forming apparatus 1 has not been turned on (No in step S401), the process of the controller 16 ends.

Step S403: The notification section 167 compares the current value P stored in the non-volatile memory 21 of the toner container 2 mounted to the first mounting section 151 with the maximum value M, and determines whether or not the current value P is smaller than the maximum value M. If the notification section 167 determines that the current value P is smaller than the maximum value M (Yes in step S403), the process of the controller 16 proceeds to Step S407. If the notification section 167 determines that the current value P is not smaller than the maximum value M (No in step S403), the process of the controller 16 proceeds to Step S405.

Step S405: The notification section 167 determines that the toner container 2 mounted to the first mounting section 151 is unused as the waste toner bottle 2*a*. That is, the notification section 167 determines that the toner container 2 is not incorrectly mounted. After that, the process of the controller 16 ends.

Step S407: The notification section 167 determines that the toner container 2 mounted to the first mounting section 151 has already been reused as the waste toner bottle 2*a*. After that, the process of the controller 16 proceeds to Step S409.

Step S409: The notification section 167 notifies a message that the toner container 2 mounted to the first mounting section 151 is incorrectly mounted. After that, the process of the controller 16 ends.

According to the embodiment, the image forming apparatus 1 in which up to the maximum capacity X of the toner container 2 can be used for collecting waste toner is provided. As a result, the number of times the waste toner bottle 2*a* is replaced is reduced.

In the description of the embodiment described above, various technically preferable limitations may be given to illustrate a preferred embodiment in the present disclosure. However, the technical scope of the present disclosure is not limited to the embodiment unless otherwise specified by descriptions limiting the present disclosure. That is, the elements of configuration in the above-described embodiment can be appropriately replaced with existing constituent elements or the like, and various variations including combinations with other existing constituent elements are possible. The descriptions of the embodiment should not be construed as limitations on the contents of the disclosure described in the scope of claims.

For example, in the embodiment, the initial remaining space S is written in the non-volatile memory 21 when the toner container 2 is shipped as illustrated in FIG. 2, but the present disclosure is not limited thereto. At least one of the maximum capacity X of the toner container 2 and the initial amount Y of toner in the toner container 2 may be written in the non-volatile memory 21. For example, if a relationship of $Y=0.8\times X$ is known, the maximum capacity X and the initial remaining space S can be calculated from the initial amount Y, and the initial amount Y and the initial remaining space S can be calculated from the maximum capacity X. The timing at which the initial remaining space S or alternative information is written in the non-volatile memory 21 may be the time when the toner container 2 is first mounted to the first mounting section 151.

Furthermore, the second calculating section 162 may correct the generated amount of waste toner according to the color of the toner used for image formation.

What is claimed is:

1. An image forming apparatus that supplies toner contained in a toner container at a time of executing image formation and collects toner remaining after the image formation as waste toner into a waste toner bottle, wherein the toner container includes non-volatile memory including a first region for storing a current value, a second region for storing a maximum value, and a third region for storing an initial remaining space of the toner container, the current value and the maximum value being initialized to 0 in an unused state of the toner container, and the image forming apparatus comprises:

a first mounting section to which the toner container is mounted;

a first calculating section that calculates a supplied amount of toner based on image data;

a writing section that writes, every time the supplied amount of toner is calculated, an integrated value of the supplied amount of toner as the current value and the maximum value in the non-volatile memory of the toner container mounted to the first mounting section;

a second mounting section to which the toner container already used is mounted as the waste toner bottle;

a second calculating section that calculates a generated amount of the waste toner based on the image data;

an updating section that updates, every time the generated amount is calculated, the current value by subtracting the generated amount from the current value stored in the non-volatile memory of the toner container mounted as the waste toner bottle to the second mounting section;

a recording section that records mounting as the waste toner bottle by updating the current value by subtracting a specified value from the current value stored in the non-volatile memory of the toner container mounted to the second mounting section as the waste toner bottle; and a detecting section that detects fullness of the waste toner bottle when the current value stored in the non-volatile memory of the toner container mounted as the waste toner bottle to the second mounting section becomes no greater than a value obtained by subtracting the initial remaining space from 0.

2. The image forming apparatus according to claim 1, further comprising a notification section that notifies, when the current value stored in the non-volatile memory of the toner container mounted as the waste toner bottle to the second mounting section is no greater than a threshold value, that the toner container capable of supplying the toner is mounted to the second mounting section.

3. The image forming apparatus according to claim 2, wherein even when the current value stored in the non-volatile memory of the toner container mounted as the waste toner bottle to the second mounting section is no greater than the threshold value, the recording section records mounting as the waste toner bottle in a case where an input indicating that the user wants use as the waste toner bottle is obtained.

4. The image forming apparatus according to claim 2, wherein the notification section compares the current value stored in the non-volatile memory of the toner container mounted to the first mounting section with the maximum value, and if the current value is smaller than the maximum value, notifies the user of that the toner container mounted to the first mounting section is incorrectly mounted.

5. The image forming apparatus according to claim 1, wherein the second calculating section corrects the generated amount of waste toner according to a color of the toner used for the image formation.

* * * * *